US006361226B1

(12) United States Patent
Blakely et al.

(10) Patent No.: US 6,361,226 B1
(45) Date of Patent: Mar. 26, 2002

(54) BELT DRIVE RACK AND TANK PHOTOGRAPHIC PROCESSING APPARATUS

(75) Inventors: Kevin H. Blakely, Rochester; Ralph L. Piccinino, Jr., Rush; Daniel M. Pagano, Honeoye Falls, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/747,086

(22) Filed: Dec. 21, 2000

(51) Int. Cl.[7] ..... G03D 3/08
(52) U.S. Cl. ..... 396/612; 396/620
(58) Field of Search ..... 396/612, 620, 396/622, 626, 636; 355/27–29; 134/64 P, 64 R, 122 P, 122 R

(56) References Cited

U.S. PATENT DOCUMENTS 3,712,206 A * 1/1973 Schmidt ..... 396/622
4,140,384 A * 2/1979 Shintani et al. ..... 396/614
4,573,790 A * 3/1986 Ducos ..... 355/28
5,432,581 A 7/1995 Patton et al. ..... 396/626
5,508,776 A 4/1996 Rosenburgh et al. ..... 396/626
5,784,661 A 7/1998 Evans et al. ..... 396/636
5,794,093 A 8/1998 Kinoshita et al. ..... 396/636

* cited by examiner

*Primary Examiner*—D. Rutledge
(74) *Attorney, Agent, or Firm*—David A. Novais

(57) ABSTRACT

A belt driven rack and tank processor includes a belt for driving photosensitive material through a relatively thin processing channel formed by the rack and tank of the processor. The belt travels around a core that displaces fluid within the apparatus so as to provide for a low volume processor. The processor further includes spring loaded engaging rollers which facilitate the conveyance of cut sheets through the processor.

17 Claims, 2 Drawing Sheets

BELT DRIVE RACK AND TANK PHOTOGRAPHIC PROCESSING APPARATUS

FIELD OF THE INVENTION

The present invention relates to the field of photography, and more particularly to a belt drive rack and tank photographic or photosensitive material processing apparatus.

BACKGROUND OF THE INVENTION

The processing of photosensitive or photographic material or film involves a series of steps such as developing, bleaching, fixing, washing and drying. These steps lend themselves to mechanization by conveying a continuous web of film or cut sheets of film or photographic paper sequentially through a series of stations or tanks, each one containing a different processing solution or liquid appropriate to the process step at that station.

There are various sizes of photographic material or film processing apparatuses, i.e., large photofinishing apparatuses and microlabs. A large photofinishing apparatus utilizes tanks that contain approximately 100 liters of each processing solution. A small photofinishing apparatus or microlab utilizes tanks that might contain less than 10 liters of processing solution.

U.S. Pat. No. 5,432,581 discribes a rack and tank arrangement that forms part of a low volume photographic material processing apparatus. The arrangement of U.S. Pat. No. 5,432,581 includes an inner rack section and an outer tank section that are easily separated. The rack and tank of U.S. Pat. No. 5,432,581 are relatively dimensioned so as to define a channel for holding a small volume of processing solution and permitting a passage of photosensitive material therethrough. In the apparatus of U.S. Pat. No. 5,432,581, a pair of input rollers are placed at an input end of the apparatus to introduce processing material into the apparatus, and a pair of output rollers are placed at an output end of the apparatus to discharge the processed photosensitive material from the apparatus. Furthermore, in addition to the input and output pair of rollers, at least three drive rollers are positioned along the processing channel, and gears are attached to designated drive rollers to drive photosensitive material along the channel. The increased use of drive rollers and gears as shown in, for example U.S. Pat. No. 5,432,581, adds cost and complexity to the apparatus. Also, the increased numbers of rollers and gears adversely affects the reliability of the apparatus since it increases the number of parts that are needed to be repaired. Furthermore, in order to properly convey cut sheets, the drive rollers need to be appropriately spaced which again, tends to increase the amount of drive rollers needed.

SUMMARY OF THE INVENTION

The present invention provides for a belt drive rack and tank processing apparatus for processing photographic material which minimizes the amount of rollers and gears necessary for the conveyance of photosensitive material. The belt drive rack and tank apparatus of the present invention requires less parts than a conventional rack and tank arrangement and facilitates the conveyance of cut sheets.

The present invention relates to an apparatus for processing photosensitive material. The apparatus comprises a tank and a rack that is adapted to be placed in the tank. The rack and the tank are relatively dimensioned so as to provide a relatively small narrow processing channel therebetween for holding a processing solution and permitting a photosensitive material to pass therethrough. The apparatus further includes a belt that extends along at least a portion of the processing channel. The belt has an outer surface which faces a photosensitive material in the processing channel and the belt is further adapted to be driven so as to convey photosensitive material along the processing channel.

The present invention further relates to a method of processing photosensitive material. The method comprises the step of introducing a photosensitive material to be processed into a relatively thin processing channel that is defined between a tank and a rack placed in the tank. The rack has a belt that extends along at least a portion of the processing channel. The method further comprises the step of conveying the photosensitive material to be processed through the processing channel by driving the belt.

DETAILED DESCRIPTION OF THE INVENTION

Figure 1:
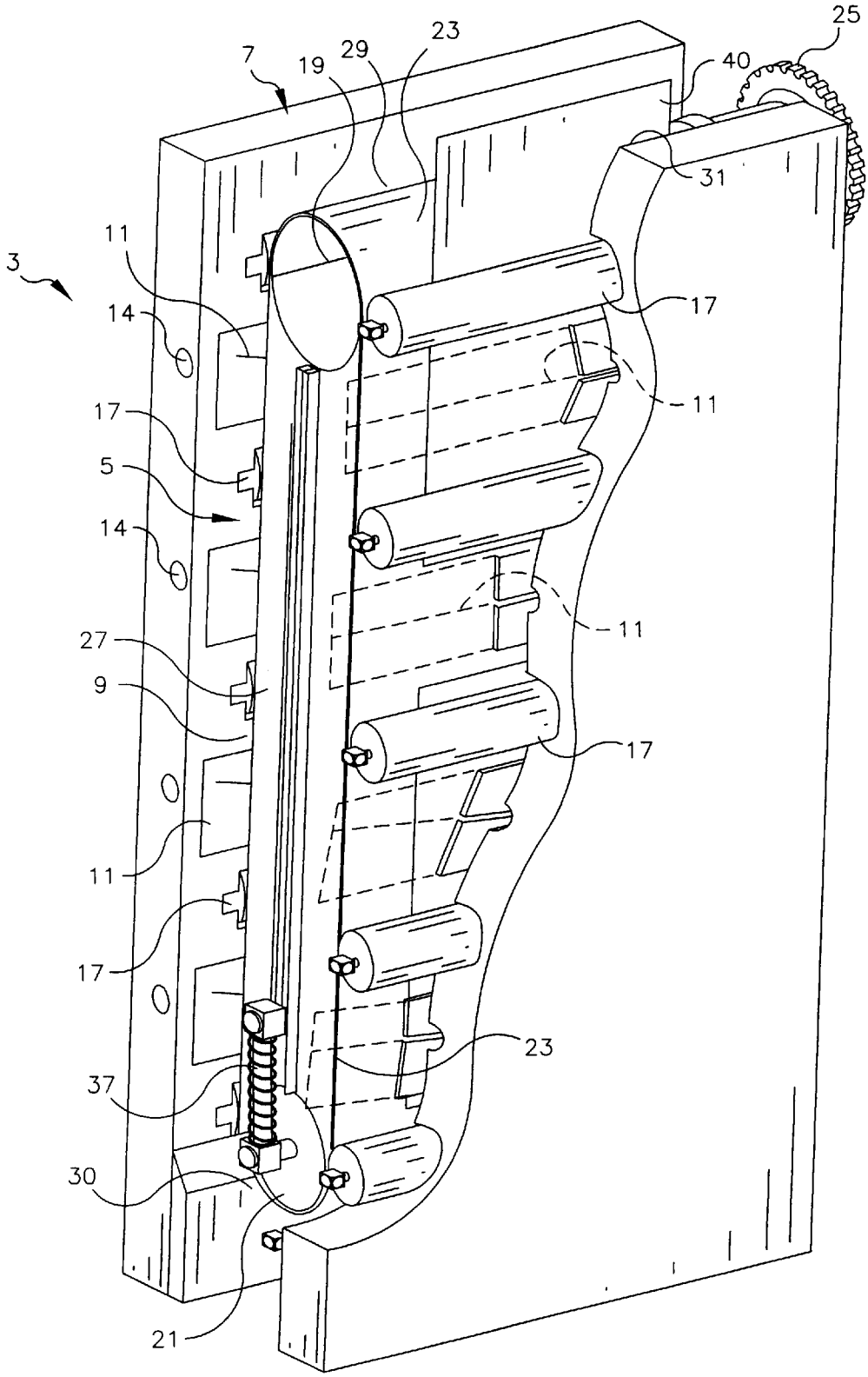
FIG. 1 is a perspective view of a belt drive rack and tank photographic processor in accordance with the present invention.

Referring now to the drawings, wherein like references numerals represent identical or corresponding parts throughout the several views, FIG. 1 shows a perspective view of a low volume belt drive rack and tank apparatus or processor 3 in accordance with the present invention. As illustrated in FIG. 1, a rack 5 is designed so as to be easily inserted and/or removed from a tank 7. Rack 5 and tank 7 form low volume processor or apparatus 3. In the view of FIG. 1, part of rack 7 is cut away so as to view the interior of processor 3.

When rack 5 is inserted within tank 7, a space which defines a narrow processing channel 9 (FIG. 2) is formed. Rack 5 and tank 7 are designed in a manner which minimizes the volume of processing channel 9. Processing channel 9 defines a path for the passage of photosensitive material or film in the form of a continuous web or cut sheets therethrough.

In the apparatus illustrated in FIG. 1, rack 7 includes slot nozzles 11 which are provided along processing channel 9. Processing solution is supplied from a known source to processing solution inlets 14 and thereafter applied to photosensitive material passing through processing channel 9, by way of slot nozzles 11. Slot nozzles 11 essentially extend through the entire width of processing channel 9.

In a known manner, processor or processing apparatus 3 includes a discharge opening in the bottom of the apparatus for discharging processing solution. This processing solution would be lead in a known manner by way of a recirculating pump to a manifold and filter arrangement. The filter arrangement would be connected to a heat exchanger which in a known manner can provide recirculated processing solution as needed back to processing apparatus 3 (see for example, U.S. Pat. No. 5,432,581). As also described in U.S. Pat. No. 5,432,581, processing chemicals can be placed in metering pumps which are used to provide the correct amount of chemicals for introduction to processing solution inlet 14.

As shown in FIG. 1, rack 5 includes a top roller 19 and a bottom roller 21. In a first feature of the present invention, an endless belt 23 is wrapped around top and bottom rollers 19, 21. Belt 23 is preferably made of a flexible material such as rubber, plastic or a plastic or rubber compound. As shown more clearly in FIG. 2, processing channel 9 is defined by an interior surface of rack 7 and an outer surface of belt 23. Belt 23 extends along at least a portion of processing channel 9 and basically defines an outer periphery of rack 5. One of the top or bottom rollers 19, 21 can be a driven roller so as to drive endless belt 23. In the embodiment of FIG. 1, top roller 19 is shown attached to a gear 25, that preferably can be driven by a driving member in the form of, for example, a motor and chain drive. However, the present invention is not limited thereto, and any of the rollers 19 or 21 can be driven by any known means for driving a roller.

As further shown in FIG. 1, tank 7 includes a plurality of freely rotatable spring loaded engaging rollers 17 which extend along processing channel 9 and face the outer surface of belt 23. Each of engaging rollers 17 is spring loaded towards belt 23 and are spaced at a desired distance to permit the conveyance of cut sheets through processing channel 9. As shown particularly in FIG. 2, hinged spring engaging rollers 17 can be preferably positioned within cutouts 17*a* in tank 7.

Figure 2:
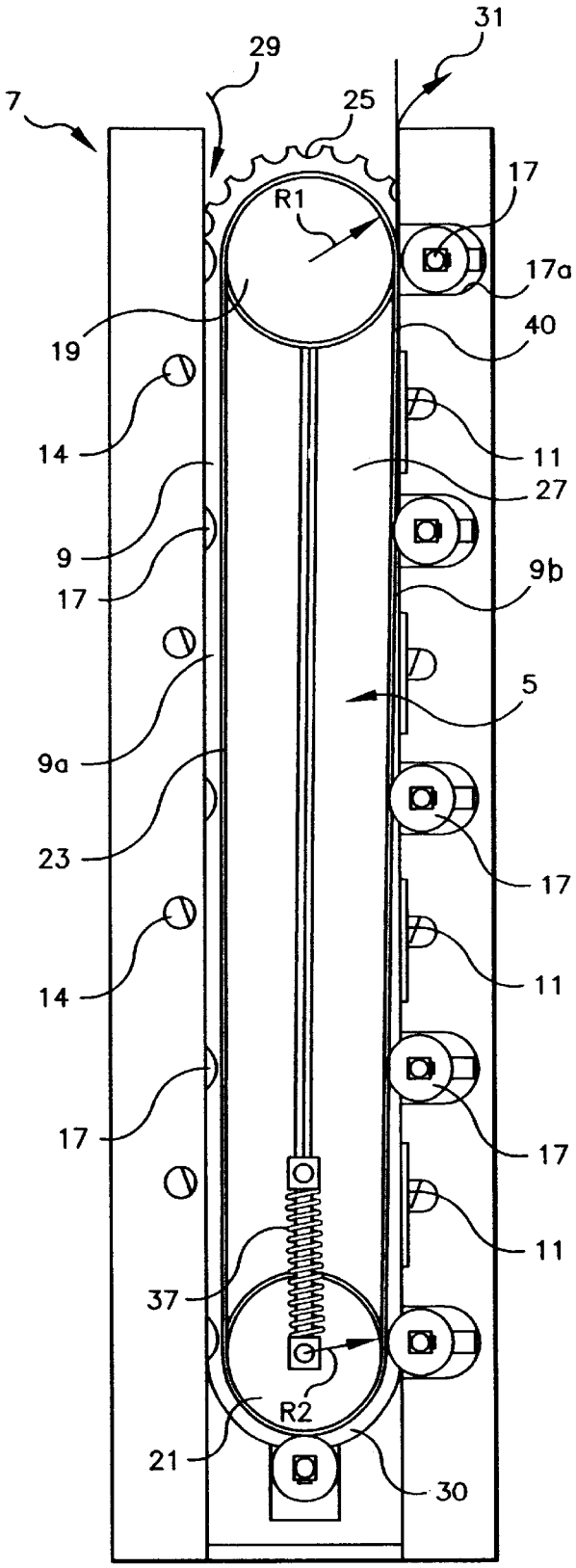
FIG. 2 is a side view of the rack and tank photographic processor of FIG. 1.

As also shown in FIGS. 1 and 2, a core 27 is provided between top and bottom rollers 19 and 21 and within belt 23. Core 27 is effective as a back surface for belt 23. Core 27 further takes up space within processing apparatus 3 so as to minimize solution volume within apparatus 3 and thus, provide for a low volume processing apparatus.

Therefore, during use of processing apparatus 3, photosensitive material or film is introduced to processing channel 9 via, for example, inlet 29. When the photosensitive material is introduced, belt 23 is driven by way of, for example, drive roller 19. The driving of belt 23 causes the conveyance of the photosensitive material along a downward portion 9*a* of processing channel 9 by way of the friction between the photosensitive material and belt 23. As the photosensitive material is conveyed along processing channel 9, an emulsion surface of the photosensitive material faces slot nozzles 11 which impinge the photosensitive material with processing solution supplied via processing solution inlet 14. As the photosensitive material 9 reaches a turn around portion 30 of processing channel 9, it is conveyed along upward portion 9*b* of processing channel 9 and if desired, is impinged by slot nozzles 11 along upward portion 9*a* of processing channel 9. It is noted that the placement of slots nozzles 11 is based on design considerations and can be placed on either the upward or downward portions of processing channel 9 or along both the upward or downward portions of processing channel 9. After exiting upward portion 9*b* of processing channel 9, the photosensitive material exits apparatus 3 via exit 31 (FIG. 2). Thereafter, the processed photosensitive material can be lead to other stations or tanks involved in the processing of the photosensitive material.

In a further feature of the present invention, due to the friction drive of the photosensitive material by way of belt 23, it is possible that over time or after prolonged use the belt can lose it elasticity. To overcome this, the present invention provides for a spring member 37 which extends from a shaft of roller 21 to a surface of core 27. Of course, it is possible that the arrangement can be reversed and spring member 37 can instead extend from top roller 19 to core 27. Spring member 37 is effective to adjust a distance between rollers 19 and 21 and therefore adjust the tension of belt 23.

In a further feature of the present invention, due to the friction drive of the photosensitive material via belt 23, especially in the vicinity of turn-around portion 30, lower roller 21 is designed to have a radius R2 which is smaller than radius R1 of upper roller 19. This assures a consistent and faster turn around speed of photosensitive material at turn around portion 30 relative to the speed of the photosensitive material in the vicinity of upper roller 19.

In a further feature of the invention, engaging rollers 17 are spaced along processing channel 9 in a manner which facilitates the conveyance of cut sheets of photosensitive material. For example, as illustrated in FIG. 2, the distance between engaging rollers 17 are such that a cut sheet 40 can be continuously conveyed between belt 23 and engaging rollers 17.

Therefore, the present invention provides for the conveyance of photosensitive material in the form of, for example, a continuous web between belt 23 and engaging rollers 17. Also, engaging rollers 17 are spaced at a particular distance so as to permit the conveyance of cut sheets 40 between belt 23 and engaging rollers 17. It is noted that engaging rollers 17 are freely rotatable and spring loaded towards belt 23 and specifically, spring loaded in a direction which is substantially perpendicular to a conveyance direction of the photosensitive material or film.

Thus, the present invention provides for a belt driven compact rack and tank processor. The belt drive is utilized to convey photosensitive material or film along a relatively thin processing channel. Engaging rollers are provided along the processing channel so as to permit the conveyance of cut sheets. Further, a core is provided within the belt so as to displace processing solution within the rack and therefore, minimize the volume of solution within the apparatus. Additionally, a spring member can be utilized to adjust the tension of the belt as needed. The arrangement of the present invention minimizes the use of rollers and gears so as to provide for a less costly and more reliable processing apparatus.

The invention has been described in detail with particular reference to certain preferred embodiments thereof, but it will be understood that variations and modifications can be effected within the spirit and scope of the invention.

What is claimed is:

1. An apparatus for processing photosensitive material, the apparatus comprising:

a tank;

a rack adapted to be placed in said tank, said rack and said tank being relatively dimensioned so as to provide a processing channel therebetween for holding a processing solution and permitting a photosensitive material to pass therethrough; and a belt which extends along at least a portion of said processing channel, said belt having an outer surface that faces a photosensitive material in said processing channel and being adapted to be driven so as to convey photosensitive material along said processing channel.

2. An apparatus according to claim 1, further comprising:

a plurality of engaging rollers positioned in said tank for engagement with said belt, such that the photosensitive material in said processing channel is conveyed between said plurality of engaging rollers and said belt.

3. An apparatus according to claim 1, wherein said belt extends substantially around an outer periphery of said rack.

4. An apparatus according to claim 2, farther comprising:

a top roller and a bottom roller about which said belt extends, one of said top and bottom rollers being driven so as to drive said belt, such that the driving of said belt permits the conveyance of said photosensitive material along said channel and between said belt and said engaging rollers.

5. An apparatus according to claim 1, further comprising:

a core provided within said belt so as to displace any processing solution from an area defined by the core.

6. An apparatus according to claim 2, wherein said engaging rollers are spring-loaded rollers that are spaced along said processing channel and come into engagement with an exterior surface of said belt.

7. An apparatus according to claim 6, wherein the photosensitive material is a cut sheet of photosensitive material and said engaging rollers are spaced along the processing channel in a manner which permits a conveyance of the cut sheets through the processing channel.

8. An apparatus according to claim 1, wherein the photosensitive material that is conveyed through the processing channel is a continuous web of material.

9. An apparatus according to claim 1, further comprising:

a top roller and a bottom roller about which said belt extends, one of said top and bottom rollers being driven so as to drive said belt, such that the driving of said belt permits the conveyance of said photosensitive material along said processing channel;

a core provided within said belt so as to displace any processing solution from an area defined by the core; and a spring member extending from one of said top or bottom rollers to the core, said spring member being operative to adjust a distance between the top and bottom rollers so as to adjust a tension of said belt.

10. An apparatus according to claim 2, wherein said top roller has a first radius and said bottom roller has a second radius which is smaller than said first radius.

11. A method of processing photosensitive material, the method comprising the steps of:

introducing a photosensitive material to be processed into a processing channel that is defined between a tank and a rack placed in the tank, the rack having a belt which extends along at least a portion of the processing channel; and conveying the photosensitive material to be processed through the processing channel by driving the belt.

12. A method according to claim 11, further comprising:

placing a core within said belt to displace any processing solution from an area within the belt.

13. A method according to claim 11, further comprising:

providing spring-loaded engaging rollers in a spaced manner along the processing channel so as to come into engagement with an outer periphery of the belt.

14. A method according to claim 13, wherein the conveying step comprises conveying the photosensitive material between the belt and the engaging rollers.

15. A method according to claim 13, wherein the photosensitive material comprises cut sheets of photosensitive material.

16. A method according to claim 11, wherein the photosensitive material comprises a continuous web of photosensitive material.

17. A method according to claim 11, wherein said belt extends around a top roller and a bottom roller, one of said top and bottom rollers being driven so as to drive said belt, such that the driving of said belt permits the conveyance of said photosensitive material along said channel, the method further comprising adjusting a distance between the top and bottom rollers to adjust a tension of the belt.

* * * * *